US011357688B1

(12) United States Patent
Metzger et al.

(10) Patent No.: US 11,357,688 B1
(45) Date of Patent: Jun. 14, 2022

(54) DIAGNOSTIC AND THERAPEUTIC INSTRUMENTS

(71) Applicant: PT By Design, LLC, Indianapolis, IN (US)

(72) Inventors: Trinda D. Metzger, Indianapolis, IN (US); Janet DeFelice, Mooresville, IN (US)

(73) Assignee: PT By Design, LLC, Indianapolis, IN (US)

( * ) Notice: Subject to any disclaimer, the term of this patent is extended or adjusted under 35 U.S.C. 154(b) by 303 days.

(21) Appl. No.: 15/462,685

(22) Filed: Mar. 17, 2017

Related U.S. Application Data

(60) Provisional application No. 62/309,570, filed on Mar. 17, 2016.

(51) Int. Cl.
*A61H 1/00* (2006.01)
*A61H 7/00* (2006.01)

(52) U.S. Cl.
CPC ..... *A61H 1/008* (2013.01); *A61H 7/003* (2013.01); *A61H 7/007* (2013.01); *A61H 2201/1253* (2013.01)

(58) Field of Classification Search
CPC ..... A61H 1/008; A61H 7/00; A61H 7/002; A61H 7/003; A61H 7/005; A61H 7/007; A61H 15/0092; A61H 2201/0157; A61H 2201/1253
USPC ..... 601/134, 135, 136, 137
See application file for complete search history.

(56) References Cited

U.S. PATENT DOCUMENTS 687,363 A * 11/1901 Wirt ..... A61H 7/003 15/188
D40,158 S * 7/1909 Apfel ..... D24/214
1,908,051 A * 5/1933 Reichl ..... A61H 15/0092 601/119
D127,824 S * 6/1941 Garas ..... D24/211
(Continued)

FOREIGN PATENT DOCUMENTS

GB 469742 A * 7/1937 ..... A61H 7/003
WO WO-0130297 A1 * 5/2001 ..... A61H 7/001

*Primary Examiner* — Justine R Yu
*Assistant Examiner* — Matthew D Ziegler
(74) *Attorney, Agent, or Firm* — Faegre Drinker Biddle & Reath LLP

(57) ABSTRACT

Unique, multifunctional, ergonomic, paired, diagnostic, and treatment instruments having one or more knobs designed to simulate the digits of the human hand are provided. These instruments include a variety of curvilinear and linear tissue engaging edges and converging surfaces that facilitate the ergonomic use of these instruments on the irregular contours of the soft tissue areas of the human or animal body. These instruments for Instrument Assisted Soft Tissue Mobilization (IASTM), are to be used for mechanical therapy such as: breaking up soft tissue adhesions, fibrotic tissue, or calcium deposits, tissue massage, deep tissue release, acupressure, joint mobilization, and self-massage. These instruments are designed for treating more than one area of the body and may be used with humans as well as domestic and farm animals. These instruments are ergonomically designed and therefore reduce stress, strain and injury to practitioner's hands and fingers and provide enhanced patient comfort.

12 Claims, 24 Drawing Sheets

(56) References Cited

U.S. PATENT DOCUMENTS 2,836,175 A * 5/1958 Nakayama ..... A61H 7/003 601/135
D185,246 S * 5/1959 Taran ..... 601/119
D226,875 S * 5/1973 Haworth, Jr. ..... D24/211
4,233,966 A * 11/1980 Takahashi ..... A61H 39/04 601/134
D269,376 S * 6/1983 Nakao ..... D24/211
D272,090 S * 1/1984 Hosid ..... D24/211
4,550,718 A * 11/1985 Kaeser ..... A61H 15/0092 601/129
4,785,800 A * 11/1988 Stilson ..... A61H 15/00 601/121
5,441,478 A 8/1995 Graston
D372,313 S * 7/1996 McMillan ..... D24/211
5,730,708 A * 3/1998 Spratt ..... A61H 7/003 601/118
5,863,251 A * 1/1999 Fusco ..... F41B 15/02 463/47.2
6,077,239 A 6/2000 Lin
6,241,693 B1 * 6/2001 Lambden ..... A61H 7/001 601/119
6,761,699 B2 * 7/2004 Chahine ..... A61H 39/00 601/134
6,887,211 B1 5/2005 Sevier et al.
D524,445 S 7/2006 Liang
D530,429 S 10/2006 Sevier et al.
7,431,706 B2 10/2008 Louis
D624,193 S 9/2010 Katzenberger
D634,022 S 3/2011 Scappaticci
D687,962 S * 8/2013 DiVittorio ..... D24/215
D712,563 S * 9/2014 Pursel ..... D24/171
9,295,608 B2 * 3/2016 Ma ..... A61H 7/004
9,925,110 B1 * 3/2018 Lang ..... A61H 7/003
2004/0015110 A1 * 1/2004 Chen ..... A61H 15/0092 601/125
2004/0064075 A1 * 4/2004 Robbins ..... A61H 7/003 601/107
2005/0165450 A1 * 7/2005 Perez-Torrens ..... A61H 1/0292 606/240
2006/0155225 A1 * 7/2006 Murdock ..... A61H 15/0092 601/131
2006/0247563 A1 * 11/2006 Martin ..... A61H 7/001 601/135
2007/0135741 A1 6/2007 Gueret
2007/0149900 A1 * 6/2007 Lin ..... A61H 7/006 601/15
2007/0265555 A1 * 11/2007 Deng ..... A61H 13/00 601/141
2008/0058687 A1 * 3/2008 Cheng ..... A61H 7/007 601/122
2009/0024064 A1 * 1/2009 Sant' Ana Caceres C11D 13/14 601/137
2009/0121059 A1 * 5/2009 Rios Garcia ..... A61H 7/003 241/92
2009/0177210 A1 7/2009 Durso
2013/0296750 A1 * 11/2013 Pursel ..... A61H 99/00 601/137
2014/0005581 A1 * 1/2014 Scappaticci ..... A61H 7/003 601/138
2014/0213945 A1 * 7/2014 Kojima ..... A61H 39/04 601/137
2014/0228723 A1 * 8/2014 Cockerill ..... A61H 15/0092 601/128
2014/0288473 A1 * 9/2014 Matsushita ..... A61H 15/00 601/137
2014/0342881 A1 * 11/2014 Almarales ..... A61H 1/0266 482/91
2014/0350445 A1 * 11/2014 Lok ..... A61H 7/007 601/137
2017/0340509 A1 * 11/2017 van den Dries ..... A61H 7/003

* cited by examiner

DIAGNOSTIC AND THERAPEUTIC INSTRUMENTS

CROSS-REFERENCE TO RELATED APPLICATION

This application claims priority to U.S. Provisional Patent Application Ser. No. 62/309,570, filed Mar. 17, 2016, the disclosure of which is hereby expressly incorporated by reference herein in its entirety.

FIELD OF DISCLOSURE

This disclosure relates to instruments to enable the practitioner to diagnose and treat fibrotic tissue, nodules, gritty tissue, granules, fibrotic ridges, tissue thickening, chronic muscle tension, facilitate the identification of damaged soft tissue, and identify misaligned joints, and mobilize joints and has shapes that are unique to current instruments.

BACKGROUND

Inflammation is the body's response to trauma. The body responds to the inflammation by forming fibrous adhesions or scar tissue to repair the trauma. It can also form chronic swelling and muscle guarding, stiffness and shortening, and reduced tissue pliability which adds to the pain inflammation cycle. When the scar tissue builds up it can restrict movement, cause pain, and joint misalignment. Without treatment it becomes a chronic inflammation and can get worse over time.

Currently, it is thought that using instruments to provide mechanical stimulation more effectively break down tightened painful tissues, nodules, capsular restrictions, muscular soft tissue restrictions, and scar tissue. Current research is also investigating the hypothesis that mechanical stimulation may actually be stimulating the release of stem cells that are necessary for healing. Mechanical stimulation appears to be helping patients heal naturally without surgery or drugs. Current research is investigating how and if mechanical stimulation causes the release of MSC's (mesenchymal stem cells) and pro resolving factors in the tissues which aid the body's healing.

Current thought is that early mobilization of an acute injury will reduce scar tissue and improve soft tissue healing. Mechanical stimulation is used to prevent fibrous adhesions after injuries, thus it is essential to maintain the mobility within joints, soft tissues, ligaments, and tendons. Deep tissue massage (deep friction massage) breaks down or prevents fibrous adhesions (scar tissue) from forming, thus promoting circulation, healthy tissue, maintaining patient mobility, and decreasing patient pain.

Therapeutic mechanical therapy in the healing stage facilitates increased circulation for better healing and increased mobilization of soft tissue structures; this in turn decreases the likelihood of fibrotic and scar tissue formation. Chronic inflammation of joints and tissues promotes fibrosis and scar tissue formation, which causes decreased mobility and increased pain. With chronic inflammation it has been shown that the breaking up of fibrotic tissue and scar tissue causes an inflammatory response that triggers the pro-resolution response facilitating the clearing out of fibrous and scar tissue, allowing the tissue or joint to become mobile again.

Soft tissue massage, deep tissue release (deep friction), acupressure, and joint manipulation have been known and practiced manually by practitioners for many years. Often the practitioner may find it difficult to apply the appropriate amount of manual pressure. When hardened scar tissue has formed on tendons, ligaments, or bony prominences, the practitioner may find it difficult to apply enough manual pressure to break down the scar tissue. Deep pressure points are often hard to get to, and maintain pressure on, using only the hands. Thus, using only the hands the practitioner may not be able to locate or detect fibrous or scar tissue. Additionally practitioners performing manual massage for many years and exerting pressure for extended periods of time may incur injury and joint damage to the practitioner's hands. Thus the use of IASTM (Instrument Assisted Soft Tissue Mobilization) or the use of mechanical therapy with instruments is becoming a large part of soft tissue healing.

The current line of tools used in mechanical therapy, for the most part, lack any spherical or round tools that simulate a thumb or fingers. Most tools currently used are flat or curved flat edged tools without good ergonomic curves and three dimensionally designed shapes for better protection of the practitioner's wrists or hands.

Additionally most of the currently available line of edged tools for mechanical therapy, have only one straight or curved edge to apply pressure against soft tissues in a flat plane unless the pointed ends are digging uncomfortably into the soft tissue.

SUMMARY

The present disclosure provides unique multifunctional, paired, ergonomic, curvilinear, diagnostic, and treatment instruments having one or more knobs designed to simulate the digits of human hands. These instruments include a variety of curvilinear and linear tissue engaging edges and converging surfaces that facilitate the ergonomic use of these instruments on the irregular contours of the soft tissue areas of the human or animal body. These instruments are to be used for mechanical therapy such as: soft tissue release, break up of fibrotic tissue, calcium deposits, massage, deep tissue release, acupressure, joint mobilization, and self-massage. This type of therapy is also known as IASTM. These instruments are designed to be multifunctional for treating more than one area of the body. These instruments are designed to apply various kinds of treatment with one instrument. These instruments may be used with humans as well as domestic and farm animals. These instruments with knobs are designed to simulate finger tips with single or multiple knob alignments on the instruments to enable the practitioner to ergonomically sustain long deep pressures to tissues during IASTM and acupressure, as well as joint mobilization. Therefore these ergonomically designed instruments can reduce stress, strain and injury and early joint deterioration to the practitioner while providing pressures more similar to finger tips.

According to an exemplary embodiment of the present disclosure, a diagnostic and therapeutic instrument is disclosed for use with a patient's soft tissue. The instrument includes: a head end; a tail end; a shaft extending between the head end and the tail end to serve as a handle, wherein the shaft is angled such that the head end is angled relative to the tail end; and at least one knob located at one of the head end and the tail end, the knob being configured to interact with the patient's soft tissue.

According to another exemplary embodiment of the present disclosure, a diagnostic and therapeutic instrument is disclosed for use with a patient's soft tissue. The instrument includes: at least one linear section configured to serve as a handle; a curved section positioned adjacent to the at least one linear section; and at least one knob located on the curved section, the at least one knob being configured to interact with the patient's soft tissue.

According to yet another exemplary embodiment of the present disclosure, a diagnostic and therapeutic instrument is disclosed for use with a patient's soft tissue. The instrument includes: a body sized to fit in a practitioner's hand, the body having a longitudinal axis; a first knob extending from the body on a first side of the longitudinal axis; and a second knob extending from the body on a second side of the longitudinal axis; wherein the first and second knobs are configured to contact the patient's soft tissue on either side of the patient's spine without another object contacting the patient's spine.

BRIEF DESCRIPTION OF THE DRAWINGS

The above-mentioned and other features and advantages of this disclosure, and the manner of attaining them, will become more apparent and the invention itself will be better understood by reference to the following description of embodiments of the invention taken in conjunction with the accompanying drawings, wherein:

FIGS. 1A-G are views of a first instrument of the present disclosure, wherein FIGS. 1A and 1B are perspective views, FIG. 1C is a top plan view, FIG. 1D is a side elevational view, FIG. 1E is a bottom plan view, FIG. 1F is a first end elevational view, and FIG. 1G is a second end elevational view;

FIGS. 2A-G are views of a second instrument of the present disclosure, wherein FIGS. 2A and 2B are perspective views, FIG. 2C is a top plan view, FIG. 2D is a side elevational view, FIG. 2E is a bottom plan view, FIG. 2F is a first end elevational view, and FIG. 2G is a second end elevational view;

FIGS. 3A-G are views of a third instrument of the present disclosure, wherein FIGS. 3A and 3B are perspective views, FIG. 3C is a top plan view, FIG. 3D is a side elevational view, FIG. 3E is a bottom plan view, FIG. 3F is a first end elevational view, and FIG. 3G is a second end elevational view;

FIGS. 4A-F are views of a fourth instrument of the present disclosure, wherein FIGS. 4A and 4B are perspective views, FIG. 4C is a side elevational view, FIG. 4D is a bottom plan view, FIG. 4E is a first end elevational view, and FIG. 4F is a second end elevational view;

FIGS. 5A-G are views of a fifth instrument of the present disclosure, wherein FIGS. 5A and 5B are perspective views, FIG. 5C is a top plan view, FIG. 5D is a side elevational view, FIG. 5E is a bottom plan view, FIG. 5F is a first end elevational view, and FIG. 5G is a second end elevational view;

FIGS. 6A-G are views of a sixth instrument of the present disclosure, wherein FIGS. 6A and 6B are perspective views, FIG. 6C is a top plan view, FIG. 6D is a side elevational view, FIG. 6E is a bottom plan view, FIG. 6F is a first end elevational view, and FIG. 6G is a second end elevational view;

FIGS. 7A-G are views of a seventh instrument of the present disclosure, wherein FIGS. 7A and 7B are perspective views, FIG. 7C is a top plan view, FIG. 7D is a side elevational view, FIG. 7E is a bottom plan view, FIG. 7F is a first end elevational view, and FIG. 7G is a second end elevational view; and FIGS. 8A-G are views of an eighth instrument of the present disclosure, wherein FIGS. 8A and 8B are perspective views, FIG. 8C is a top plan view, FIG. 8D is a side elevational view, FIG. 8E is a bottom plan view, FIG. 8F is a first end elevational view, and FIG. 8G is a second end elevational view.

Corresponding reference characters indicate corresponding parts throughout the several views. The exemplifications set out herein illustrate exemplary embodiments of the invention and such exemplifications are not to be construed as limiting the scope of the invention in any manner.

DETAILED DESCRIPTION

Figure 1A:
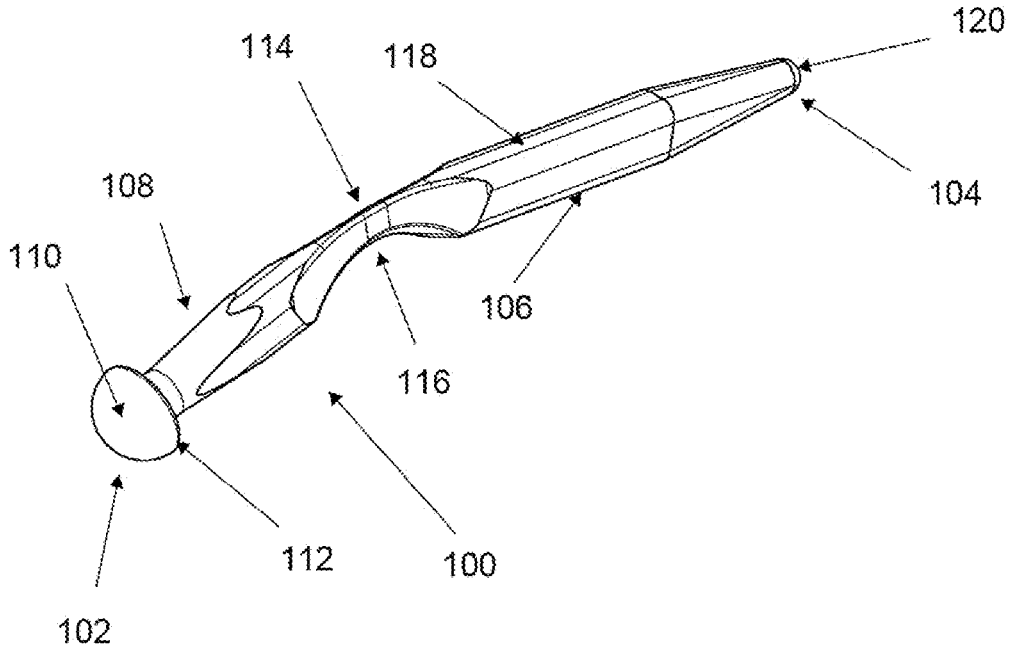
Figure 1B:
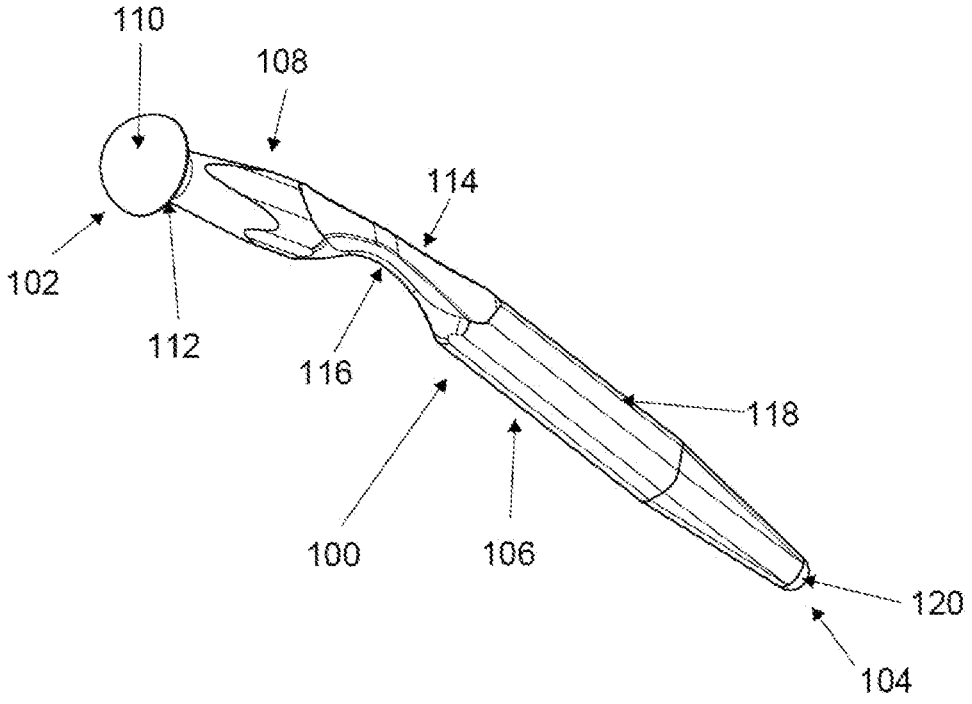
Figure 1C:
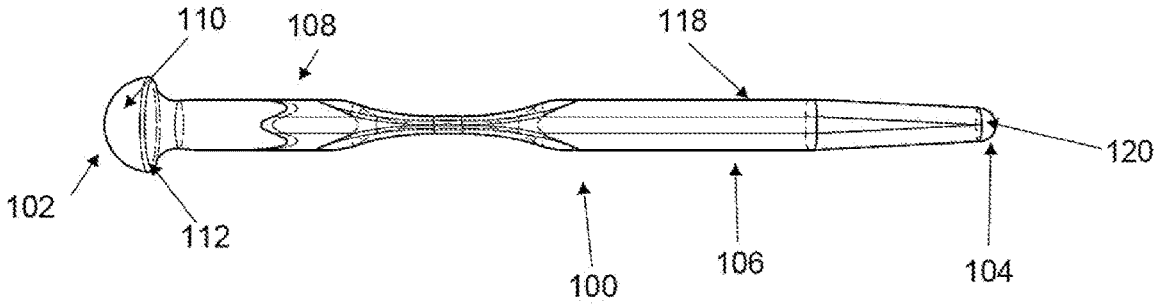

FIGS. 1A-I show a first embodiment of the instrument 100 having a proximal or head end 102, a distal or tail end 104, and an elongated stem 106 between the head end 102 and the tail end 104. The length of the instrument 100 from the head end 102 to the tail end 104 may be about 3 inches to 36 inches, although this length may vary depending on the intended patient.

The first or head end 102 of the instrument 100 includes a knob 110 that is a rounded, semi-spherical shape (i.e., half orb) with a beveled edge 112 positioned in the middle of the knob 110 and extends to the stem 106 of the instrument 100. The knob 110 of the instrument 100 can be used for acupressure and ischemic compression as well and deep tissue massage. In certain embodiments, the knob 110 has a diameter of about ¼ inch to 2 inches, although this diameter may vary depending on the overall size of the instrument 100 and the intended patient. The ergonomic design allows deep and sustained pressure on specific tissues. The ergonomic design of the instrument 100 may protect the practitioner's thumb or digits.

The second or tail end 104 of the instrument 100 includes a smaller knob 120 that is a rounded, cone shape (i.e., ogive). The smaller knob 120 of the instrument 100 can be used for acupressure, ischemic compression, deep tissue massage, cross fiber strumming and lifting of the muscle. In certain embodiments, the smaller knob 120 has a diameter of about ¼ inch to 1 inch, although this diameter may vary depending on the overall size of the instrument 100 and the intended patient.

The stem 106 of the instrument 100 includes a proximal portion 108 adjacent to the head end 102, and a distal portion 118 adjacent to the tail end 104. The stem 106 is bent or angled such that proximal portion 108 is angled relative to the distal portion 118 at an obtuse angle 122 of about 100-170 degrees, more specifically about 150-170 degrees, and more specifically about 160 degrees (See FIG. 1D). The proximal portion 108 of the stem 106 may include four flat sides and rounded corners between the flat sides. The distal portion 118 of the stem 106 may serve as a linear handle that is flat on four sides with rounded corners between the flat sides. The head end 102 of the instrument 100 will allow further leverage when the practitioners apply one hand on top of the four sided handle 118 and another hand on top of the head end 102 to apply deep pressure to tissues and to be able to mobilize joint structures with the head end 102 of instrument 100 while holding the handle 118 to allow for better ergonomics.

The handle 118 enables a secure grip with an ergonomic angle 122 relative to the head end 102 that may further lessen pressure on the wrists, hands, and fingers of the practitioner.

The beveled edge 112 on the knob 110 of the instrument 100 enables another level of massage, allowing the practitioner to lift and grab and stretch tissue, and assist in restoring pliability.

Figure 1D:
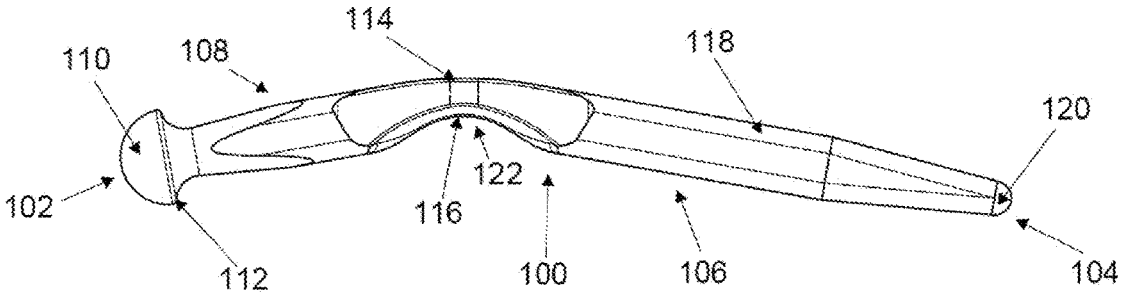
Figure 1E:
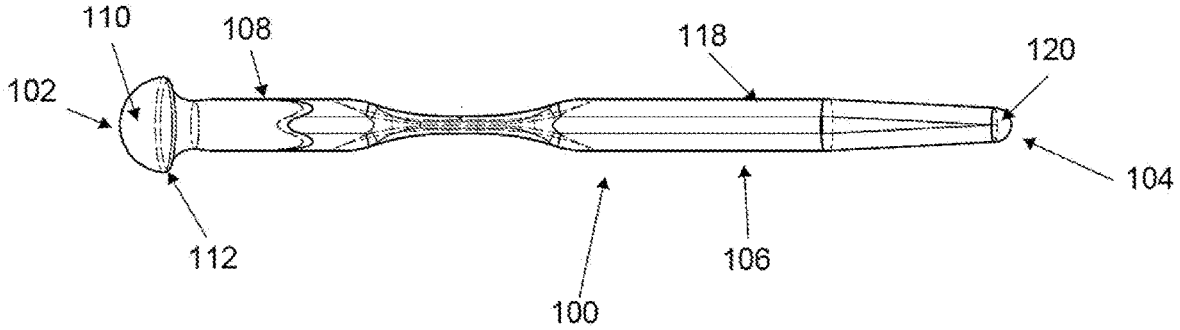
Figure 1F:
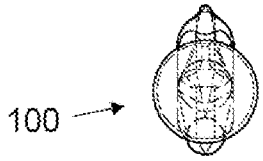
Figure 1G:
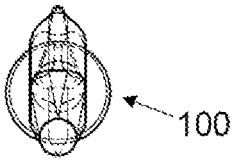
Figure 2A:
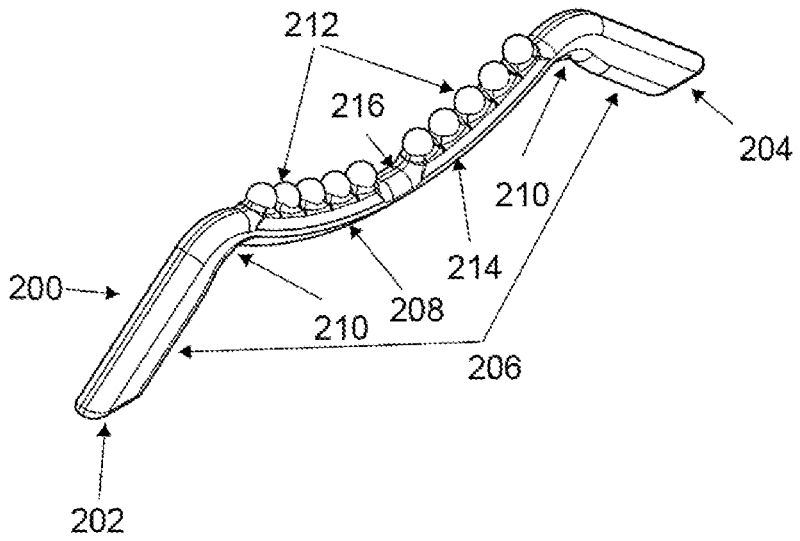
Figure 2B:
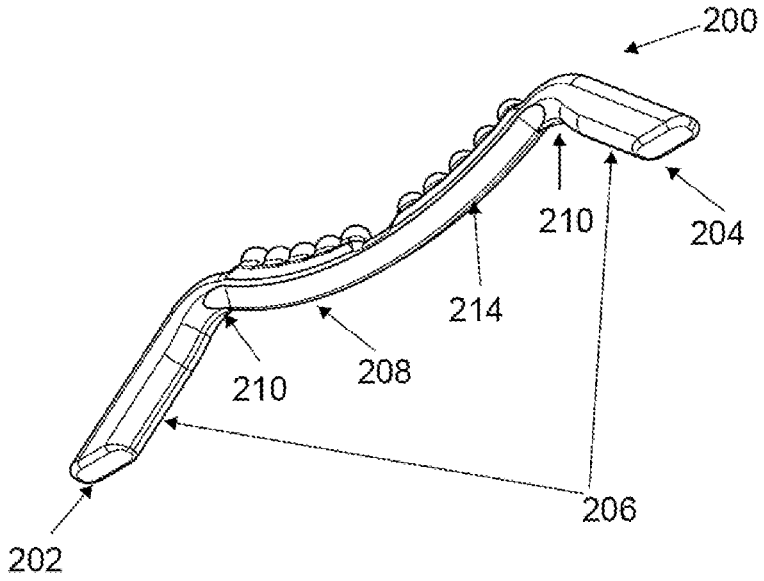
Figure 2C:
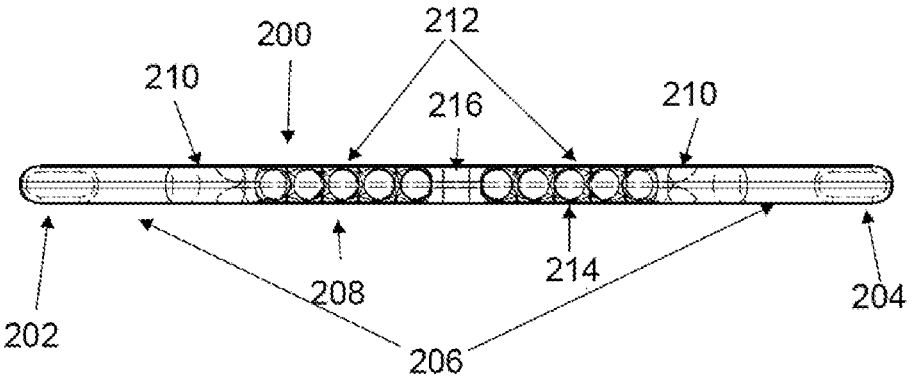
Figure 2D:
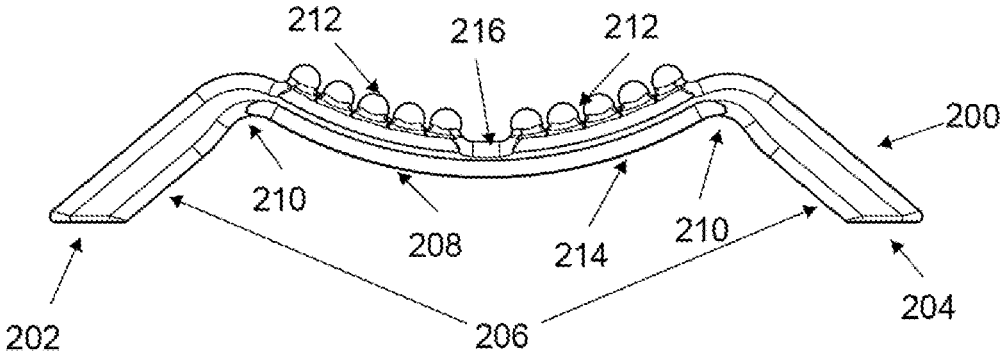
Figure 2E:
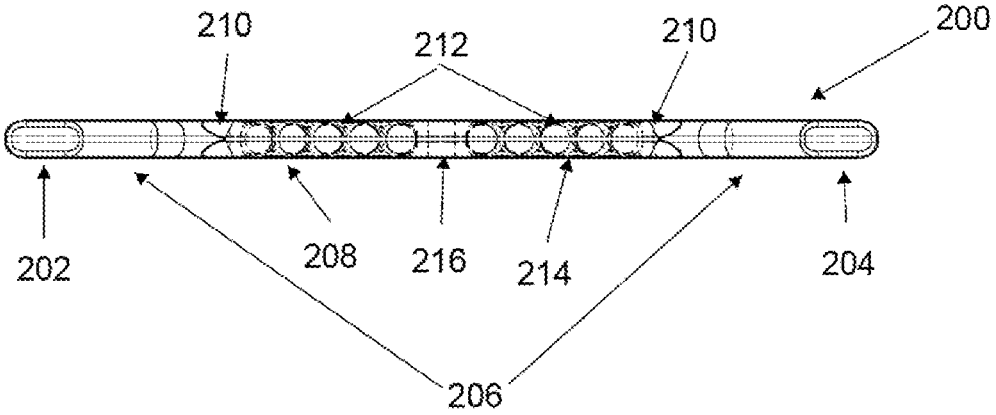
Figure 2F:
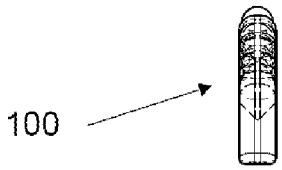
Figure 2G:
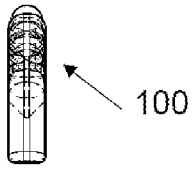
Figure 3A:
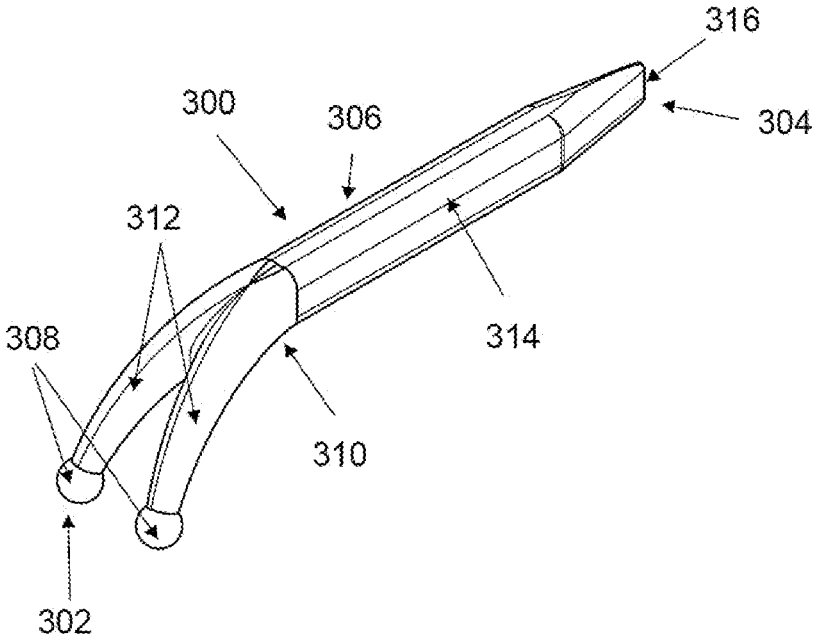
Figure 3B:
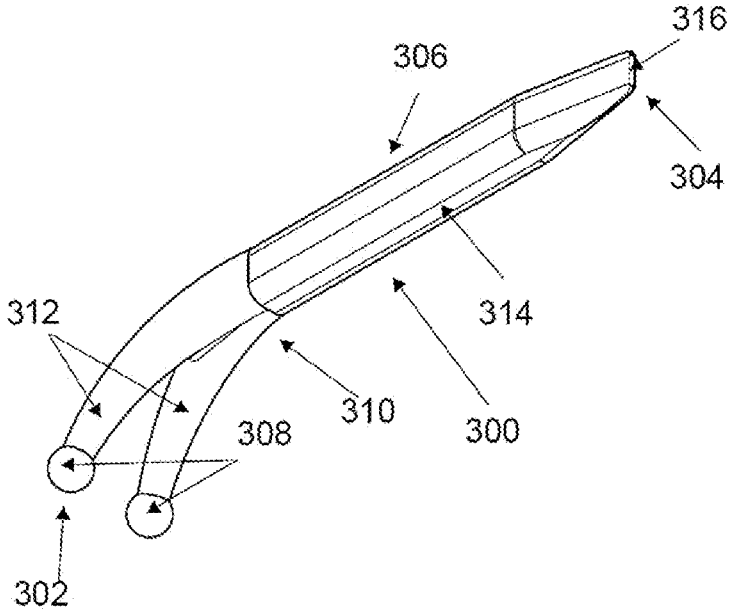
Figure 3C:
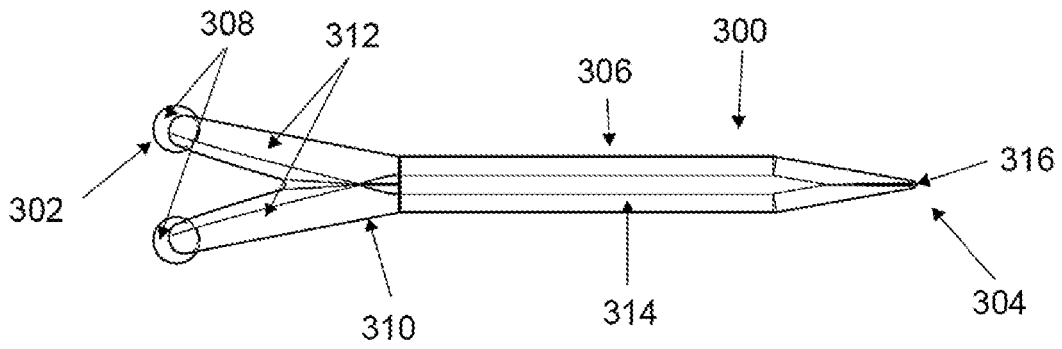
Figure 3D:
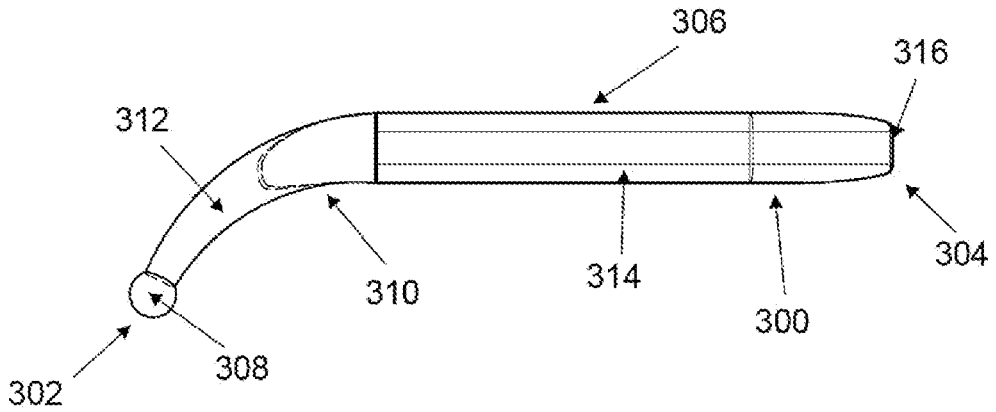
Figure 3E:
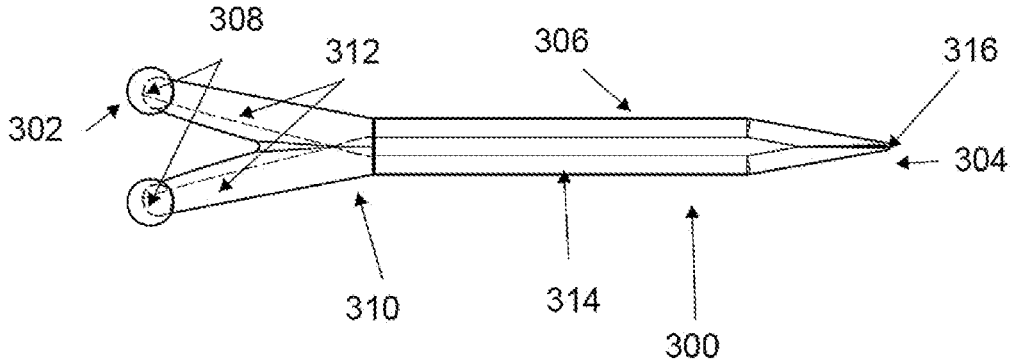
Figure 3F:
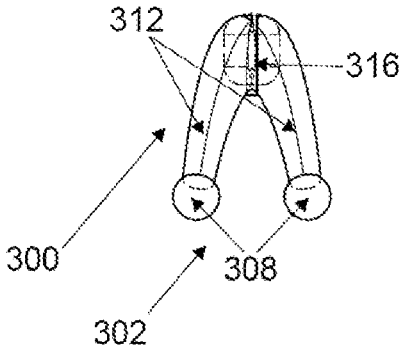
Figure 3G:
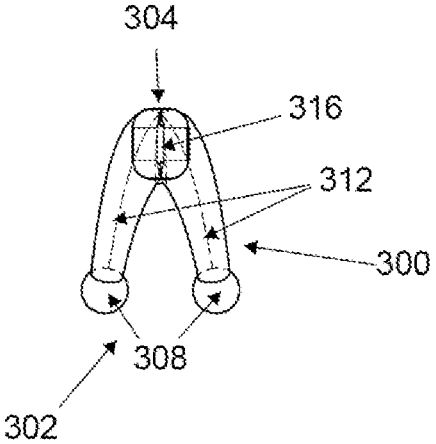
Figure 4A:
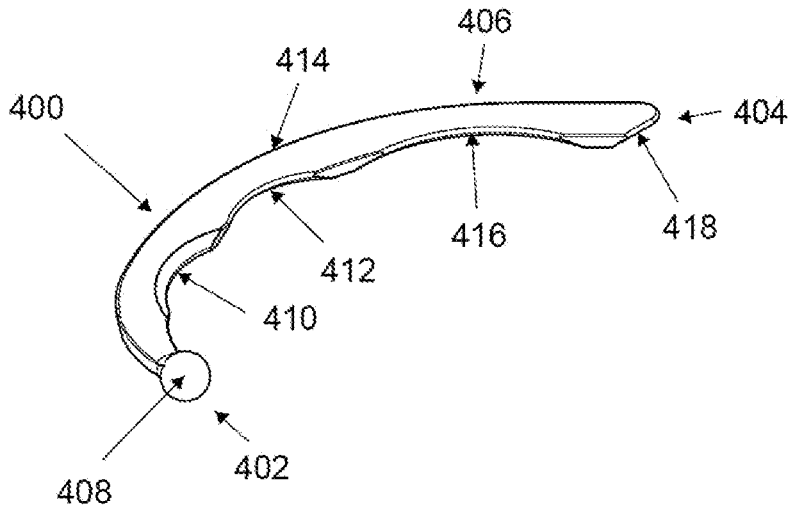
Figure 4B:
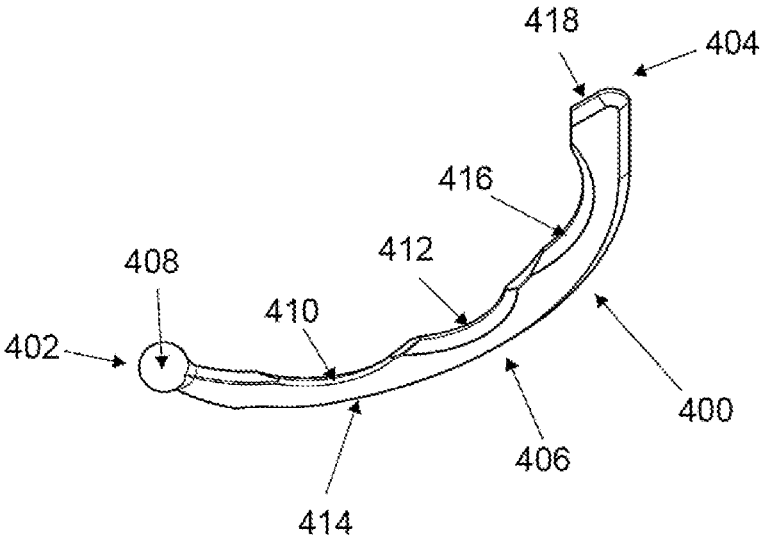
Figure 4C:
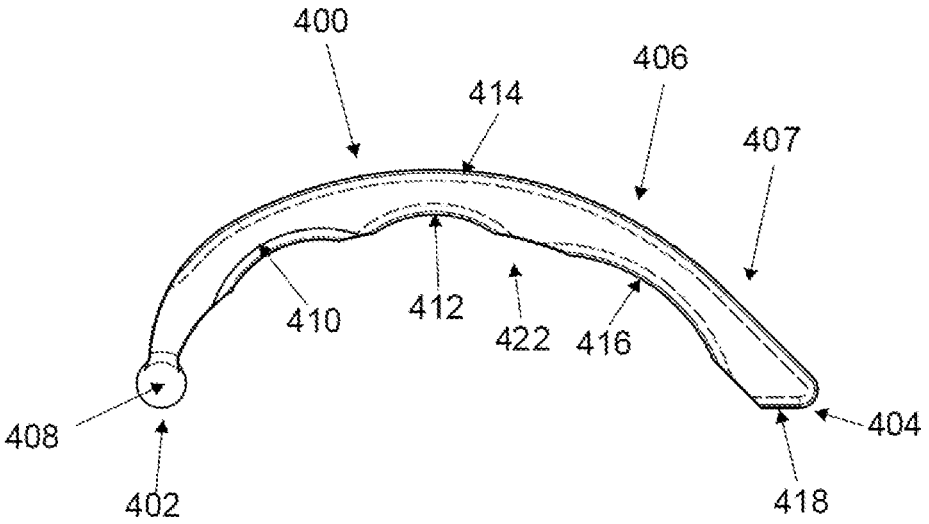
Figure 4D:
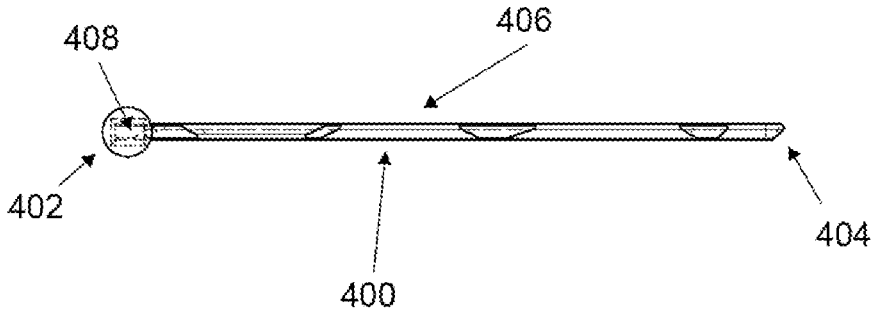
Figure 4E:
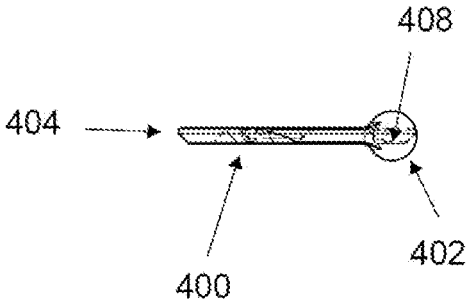
Figure 4F:
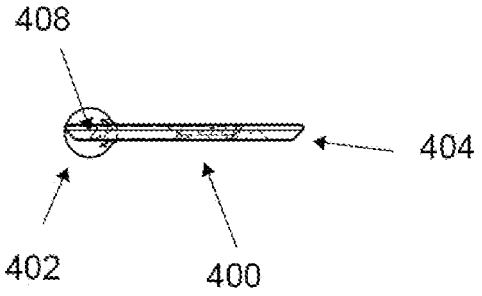
Figure 5A:
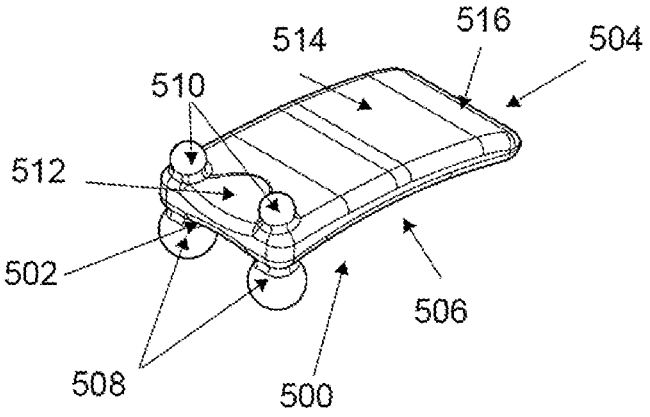
Figure 5B:
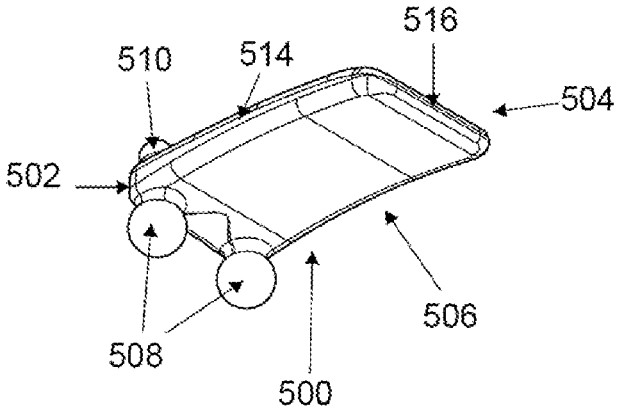
Figure 5C:
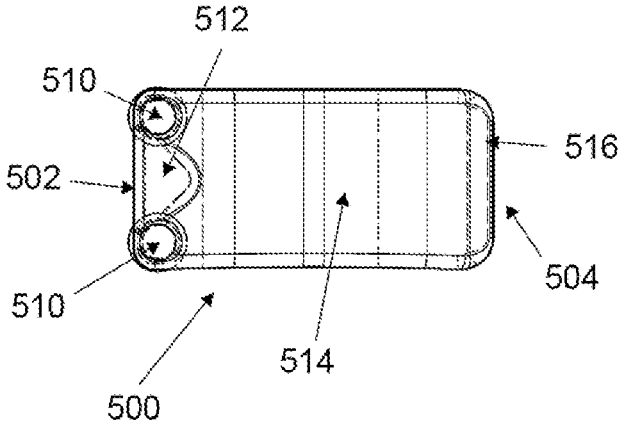
Figure 5D:
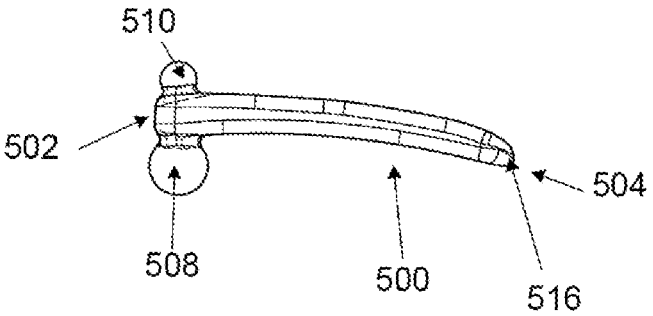
Figure 5E:
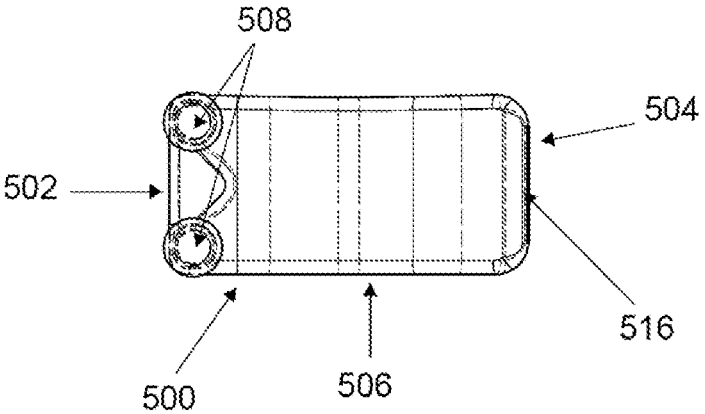
Figure 5F:
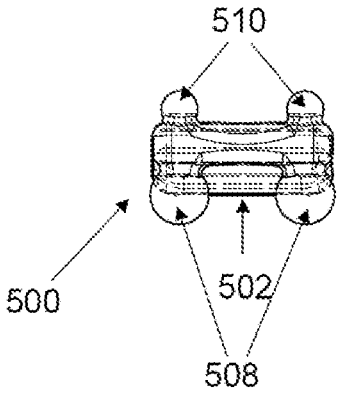
Figure 5G:
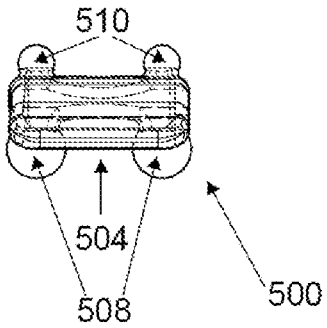
Figure 6A:
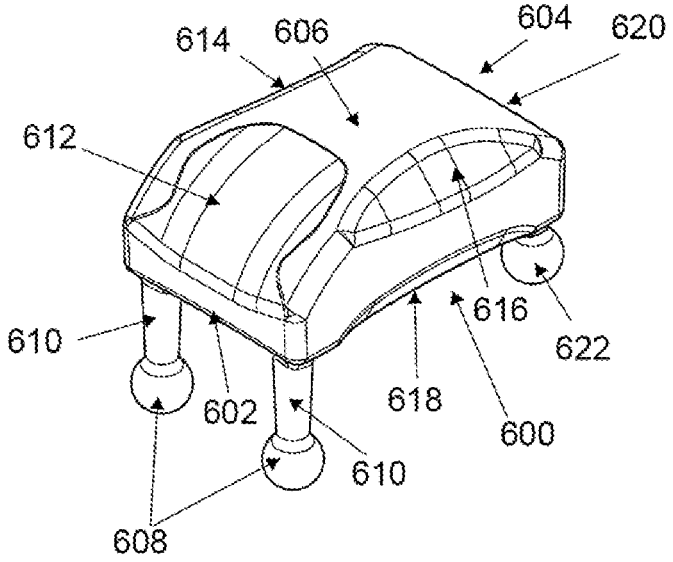
Figure 6B:
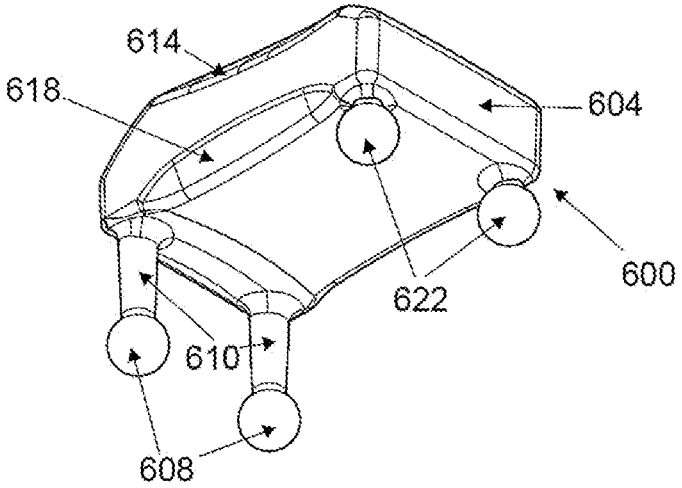
Figure 6C:
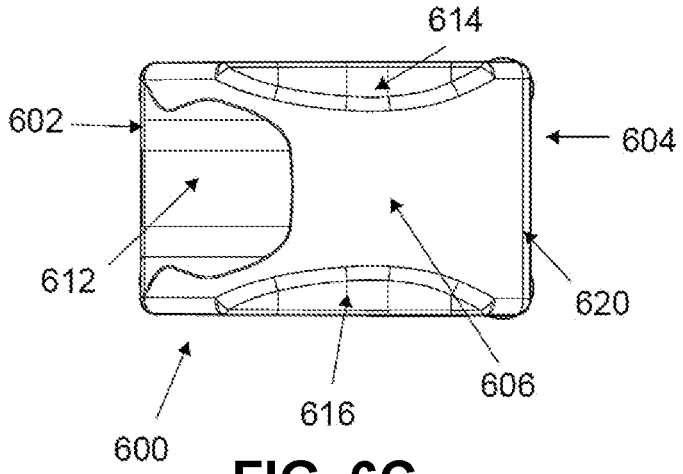
Figure 6D:
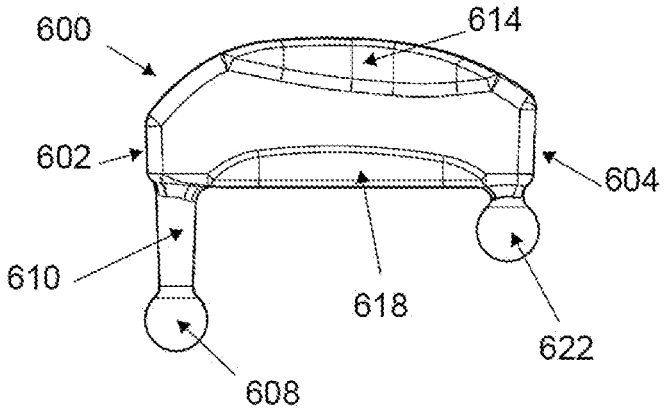
Figure 6E:
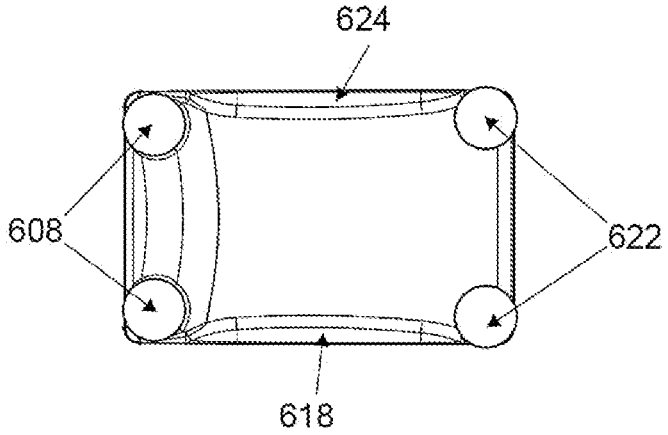
Figure 6F:
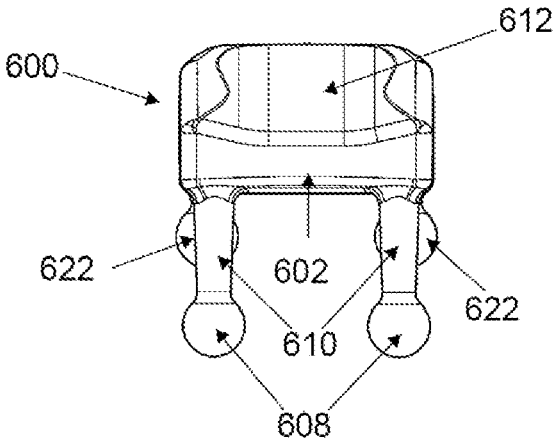
Figure 6G:
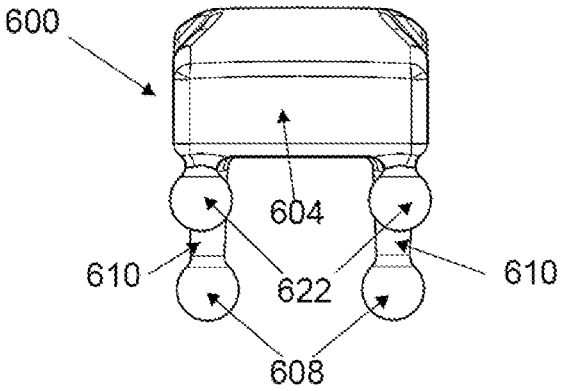
Figure 7A:
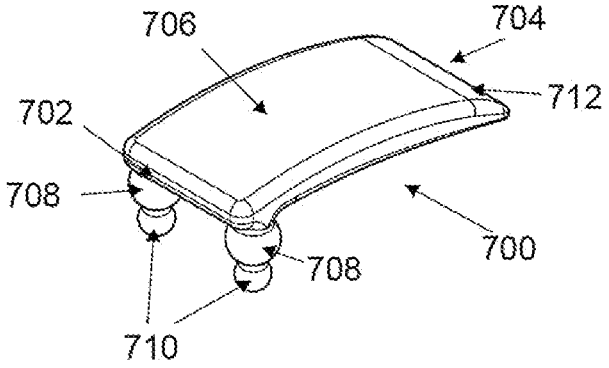
Figure 7B:
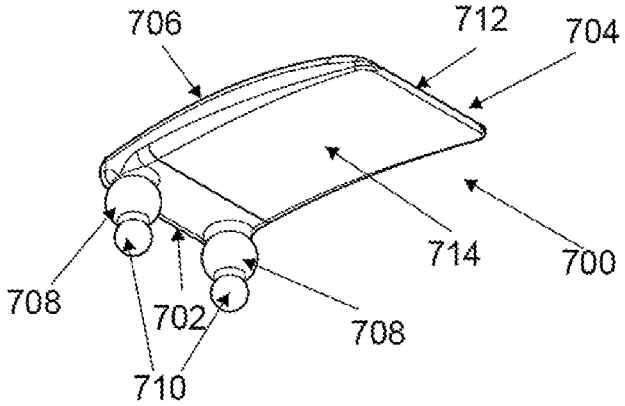
Figure 7C:
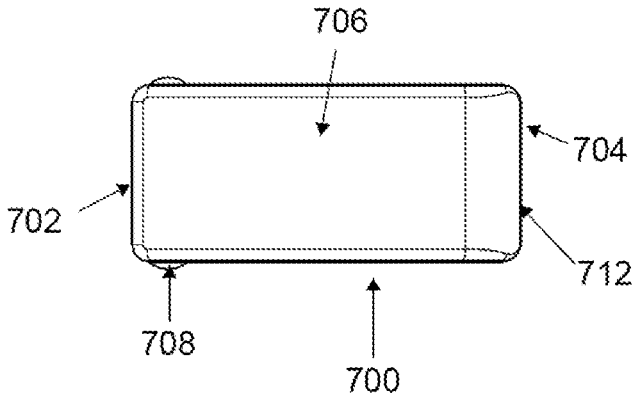
Figure 7D:
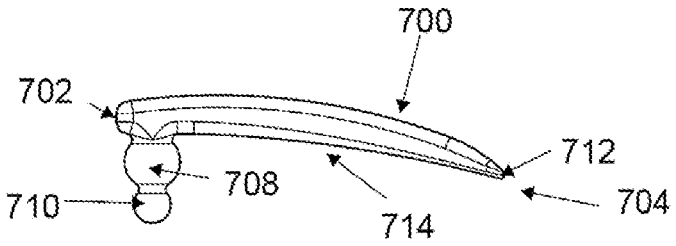
Figure 7E:
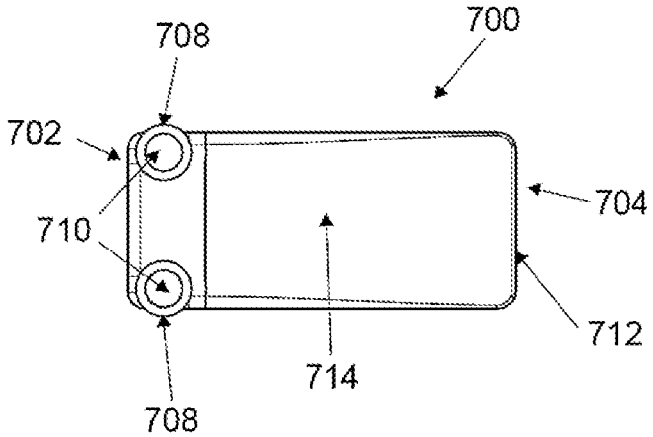
Figure 7F:
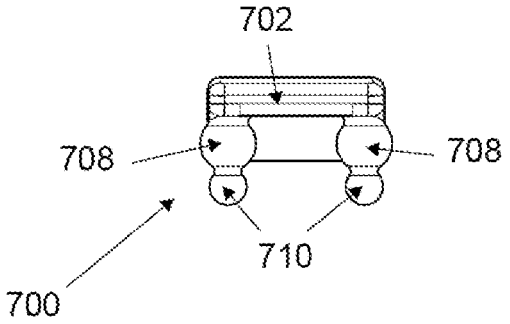
Figure 7G:
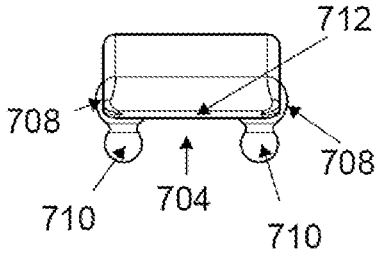

Along the angle 122, the instrument 100 includes an upper convex edge 114 and a lower concave edge 116 (See FIG. 1D). The edges 114 and 116 may be sharp corners, rounded edges or beveled edges. The edges 114 and 116 can be used on muscles or joints that have rounded shapes or curves like the calf muscles, the curve of the anterior tibialis muscle, the forearm or shoulder muscles, the curves of the arch of the foot, the ball of the foot, and the ankles and knee joints as well as the curves of the hips, back, and trunk.

Elements 110, 112, 114 116, and 120 are considered the tools of the instrument 100 that work together to provide for more comfortable treatment and leverage. While grasping handle 118, the practitioner will be able to apply deep pressure using either the knob 110 located at the head end 102 of instrument 100 or the smaller knob 120 located at the tail end 104 of the instrument 100, both designed for deep massage and deep acupressure to areas of varying sizes and needs. The concave beveled edge 116 located along the stem 106 provides additional massage and release features to this soft tissue instrument 100. The beveled edge 112 located at the head end 102 enables another level of massage, allowing the therapist to lift and grab and stretch tissue, and assist in restoring pliability.

FIGS. 2A-G show a second embodiment of the instrument 200 having a first end 202, a second end 204, each end 202 and 204 including a handle 206, with an arced stem 208 between the handles 206.

Figure 8A:
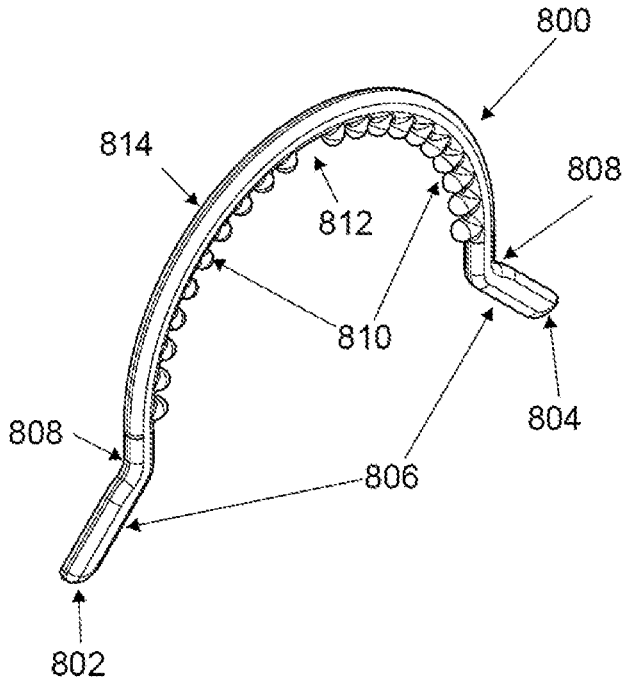
Figure 8B:
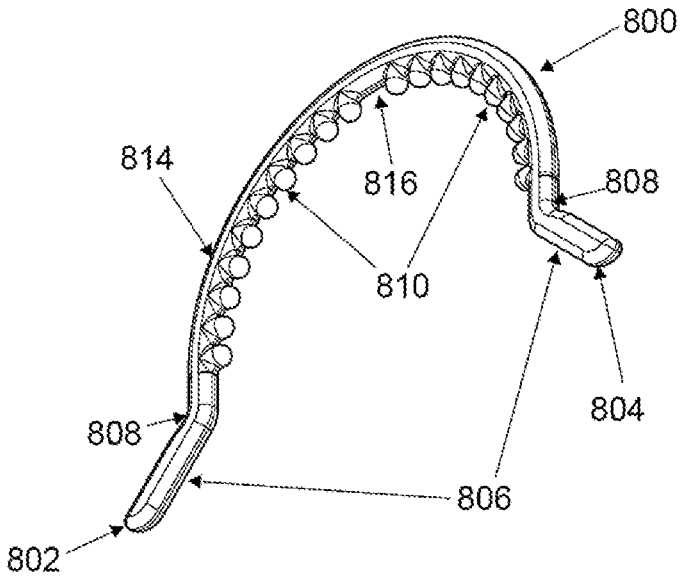
Figure 8C:
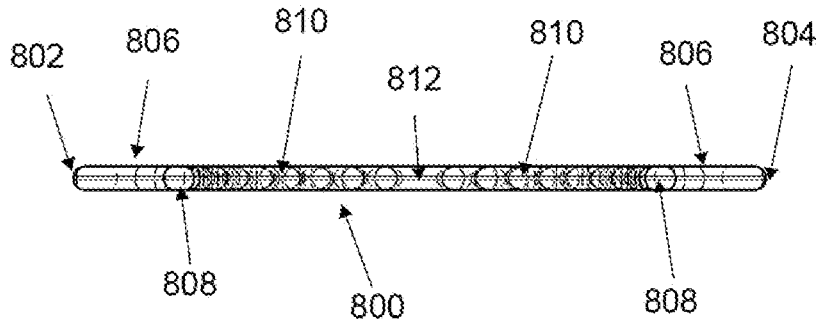
Figure 8D:
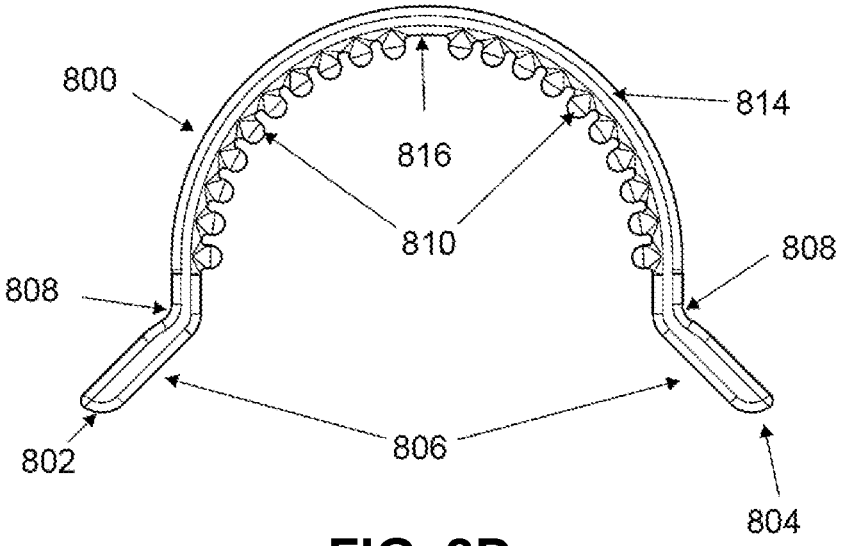
Figure 8E:
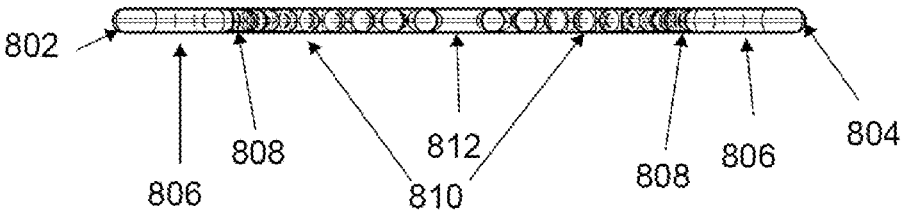
Figure 8F:
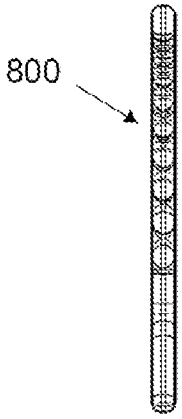
Figure 8G:
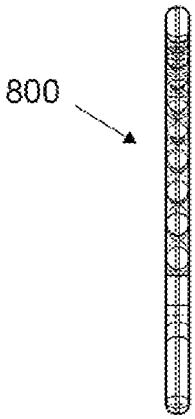

The first end 202 of the instrument 200 includes a first linear handle 206 that flows into an angle 210 then into the arced stem 206 of the instrument 200 and then into another angle 210 and a second linear handle 206 at second end 204. The angles 210 of the handles 206 may be obtuse angles of about 100-170 degrees, more specifically about 120-140 degrees, and more specifically about 130 degrees (See FIG. 2D). Such angles 210 may be ergonomic for the practitioner when using the instrument 200, allowing the practitioner to apply appropriate pressure and angles and to reach difficult areas. In another embodiment, the angles 210 of the handles 206 may be reversed to face in the opposite direction to facilitate use by the client for self-treatment. See, for example, angles 808 of instrument 800 (FIG. 8D), which is described further below.

A plurality of knobs 212 sit on the top side of the arced stem 206 of the instrument 200 and are spaced apart from each other in the center 216 of stem 206 to contact both sides of the spinous process, but not the spinous process itself. The illustrative knobs 212 are generally spherical in shape (i.e., orbs). The knobs 212 are used for massage and treatment on various areas of the body (i.e., neck, back, torso, and thigh). In the illustrated embodiment, a bi-beveled edge 214 is provided on the bottom side of the arced stem 208 of the instrument 200, which may be use for diagnosis and treatment. In another embodiment, additional knobs may be provided on the bottom side of the arced stem 206, and these additional knobs may be smaller than knobs 212. The instrument 200 is ergonomic for the practitioner allowing better pressure and more specific pressure to be applied with less stress to the practitioner and to provide a soothing massage to the client while holding handles 206.

Elements 212 and 214 are considered the tools of instrument 200 that work together to provide for more comfortable treatment and leverage.

FIGS. 3A-G show a third embodiment of the instrument 300 having a proximal or head end 302, a distal or tail end 304, and an elongated stem 306 between the head end 302 and the tail end 304. The instrument 300 is similar to the instrument 100, except as described below.

Similar to the stem 106 of the instrument 100, the stem 306 of the instrument 300 may serve as a handle. Also, the stem 106 may be bent or angled such that the proximal end 302 of instrument 300 is angled relative to the distal end 304 of instrument 300 at an obtuse angle 310 of about 100-170 degrees, more specifically about 150-170 degrees, and more specifically about 160 degrees (See FIG. 3D).

The head end 302 of the instrument 300 includes two knobs 308, each of which is a spherical shape (i.e., orb). The knobs 308 are spaced apart from each other to contact on both sides of the spinous processes and connected to the stem 306 of the instrument 300 through projections 312. The spherical knobs 308 of the instrument 300 can be used for acupressure and ischemic compression as well and deep tissue massage. Two spherical knobs 308 allow for separation of muscle and tissue acting like fingers. The ergonomic design allows deep and sustained pressure on specific tissues like the paraspinals bilaterally. The bilateral orb design allows the practitioner to test joint mobility of individual spinal segments as well allow for joint mobilization to restricted segments. The ergonomic design of the instrument 300 will protect the practitioner's digits.

The distal or tail end 304 of instrument 300 includes a bi-beveled edge 316 that may be used for treatment and diagnosis.

Elements 308, 314, and 316 are considered the tools of the instrument 300 that work together to provide for more comfortable treatment and leverage.

FIGS. 4A-F show a fourth embodiment of the instrument 400 having a proximal or head end 402 and a distal or tail end 404, and an elongated semi-circular stem 406 between the head end 402 and tail end 404. The instrument 400 is similar to the instrument 100, except as described below.

The first or head end 402 of the instrument 400 includes a knob 408 that is a spherical shape (i.e., orb) and connected to the stem 406 of the instrument 400. The spherical knob 408 of the instrument 400 can be used for acupressure and ischemic compression as well and deep tissue massage. The ergonomic design allows deep and sustained pressure on specific tissues. The ergonomic design of the tool will protect the practitioner's thumb or digits.

The second or tail end 404 of instrument 400 includes a straight beveled edge 418. The straight beveled edge 418 of the instrument 400 can be used for deep tissue massage, cross fiber strumming and lifting of the muscle.

The stem 406 of instrument 400 includes two flat sides, a linear bottom section 407 (FIG. 4C), a convex top beveled edge 414, and concave bottom beveled edges 410, 412, and 416 between the flat sides. The stem 406, in particular the linear bottom section 407 of the stem 406, may serve as a handle of instrument 400. Stem 406 is bent or angled such that the first end 402 is angled relative to the second end 404 at an acute angle 422 of about 45-85 degrees, more specifically about 65-80 degrees, and more specifically about 75 degrees (See FIG. 4C). In other embodiments, the angle 422 may be an obtuse angle (e.g., obtuse angle 122 of instrument 100 and/or obtuse angle 310 of instrument 300). The first end 402 of instrument 400 will allow further leverage and better ergonomics to apply deep pressure with tool 408 when by applying one hand on the top of the two sided stem 406 near top beveled edge 414 and holding the bottom section 407 of stem 406 near beveled edge 416 with the other hand.

The top beveled edge 414 of the stem 406 is designed as a diagnostic tool to provide the practitioner with accurate information about the injuries of the affected tissue and to be used as a treatment tool to massage and release soft tissue.

The bottom beveled edges 410, 412, and 416 of the semi circled stem 406 of instrument 400 may be used for diagnosis, treatment, and massage.

Elements 408, 410, 412, 414, 416, and 418 are considered the tools of instrument 400 that work together to provide for more comfortable treatment and leverage.

FIG. 5A-G show a fifth embodiment of the instrument 500 having a proximal or head end 502, a distal or tail end 504, sides 506, and a dome shaped body 514 between the head end 502 and the tail end 504. The instrument 500 is similar to the instrument 700, except as described below.

Body 514 may serve as a handle of instrument 500. The upper surface of body 514 may have some curvature to fit within the practitioner's hand. In certain embodiments, body 514 may include additional upper and lower contours 512 to accommodate the practitioner's fingers.

The front end 502 of the underside of the dome shaped body 514 of the instrument 500 includes two knobs 508, each of which is a spherical shape (i.e., full orb). This configuration allows for deep massage with tissue and muscle separation. The two knobs 508 are spaced apart from each other along the longitudinal axis of body 514 to contact both sides of the spinous process, but not the spinous process itself.

The front end 502 of the top side of the dome shaped body 514 of the instrument 500 includes two knobs 510, each of which is a spherical shape (i.e., full orb). This configuration allows for deep massage with tissue and muscle separation. The two knobs 510 are spaced apart from each other along the longitudinal axis of body 514 to contact both sides of the spinous process, but not the spinous process itself. The knobs 510 may be smaller in diameter than the knobs 508. Other than the knobs 508 and 510, there are no other knobs or objects positioned along the longitudinal axis of body 514 that would interfere with the spinous process.

The distal end 504 of instrument 500 includes a beveled edge 516 that may be used for massage and diagnosis.

Elements 508, 510 and 516 are considered the tools of the instrument 500 that work together to provide for more comfortable treatment and leverage.

FIG. 6A-G show a sixth embodiment of the instrument 600 having a proximal or head end 602, a distal or tail end 604 and a dome shaped body 606 between the head end 602 and the tail end 604.

Body 606 may serve as a handle of instrument 600. The upper surface of body 606 may have some curvature to fit within the practitioner's hand. In certain embodiments, body 606 may include additional contours 612, 614, 616, 618, 620, and 624 to accommodate the practitioner's fingers.

The proximal or head end 602 of instrument 600 includes round finger-like extensions 610 that support the proximal knobs 608. The illustrative knobs 608 are spherical in shape (i.e., orbs). The extension 610 of the knobs 608 allows for deep massage, muscle and tissue separation and vertebral realignment. The distal or tail end 604 of instrument 600 may include similar knobs 622 coupled to the body 606 through shorter extensions (not shown) or without such extensions (See FIG. 6D). The knobs 608 and 622 are spaced apart from each other along both the longitudinal axis of body 606 and the transverse axis of body 606 to contact both sides of the spinous process, but not the spinous process itself. Other than the knobs 608 and 622, there are no other knobs or objects positioned along the axes of body 606 that would interfere with the spinous process.

Elements 608 and 622 are considered the tools of the instrument 600 that work together to provide for more comfortable treatment and leverage.

FIGS. 7A-G show a seventh embodiment of the instrument 700 having a proximal or head end 702, a distal or tail end 704 and a dome shaped body 706 between the head end 702 and the tail end 704.

Body 706 may serve as a handle of instrument 700. The upper surface of body 706 may have some curvature to fit within the practitioner's hand. In certain embodiments, body 706 may include additional contours to accommodate the practitioner's fingers.

The front end 702 of the underside 714 of the dome shaped body 706 of the instrument 700 includes two sets of stacked knobs 708 and 710, including two upper knobs 708 that are spherical in shape (i.e., orbs) and two lower knobs 710 that are semi-spherical in shape (i.e., half orbs) stacked on the upper knobs 708. The lower knobs 710 may be smaller in diameter than the upper knobs 708. This stacked configuration allows for deep massage with tissue and muscle separation from the lower knobs 710 and secondary massage at the same time from the upper knobs 708. The two sets of stacked knobs are spaced apart from each other along the longitudinal axis of body 706 to contact both sides of the spinous process, but not the spinous process itself. Other than the knobs 708 and 710, there are no other knobs or objects positioned along the longitudinal axis of body 706 that would interfere with the spinous process. The second end 704 of instrument 700 includes a beveled edge 712 that may be used for massage and diagnosis.

Elements 708,710, and 712 are considered the tools of instrument 700 that work together to provide for more comfortable treatment and leverage.

FIGS. 8A-G show an eighth embodiment of the instrument 800 having a first end 802 and a second end 804, each end 802 and 804 including a handle 806, with a semi-circular stem 816 between the handles 806.

The first end 802 of instrument 800 includes a first linear handle 806 that flows into an ergonomic angle 808 that flows into a semi-circular stem 816 that flows into another ergonomic angle 808 then into a second linear handle 806 at the second end 804. The angles 808 of the handles 806 may be obtuse angles of about 100-170 degrees, more specifically about 120-140 degrees, and more specifically about 130 degrees, which are ergonomic for the user when using instrument 800 for self-treatment (See FIG. 8D). The angles 808 of the handles 806 may face the opposite direction as angles 210 of the instrument 200 (FIG. 2D) to facilitate self-treatment.

A plurality of small knobs 810 set on the inside of the semi-circular stem 816 may be used for massage and muscle and tissue separation on large muscle groups of the body (i.e., back, torso, thigh). The illustrative knobs 810 are generally spherical in shape (i.e., orbs). The knobs 810 may be spaced close together as illustrated or spaced farther apart (e.g., about 1-2 inches apart) for better separation of muscle and tissue depending on the needs of the patient. The illustrative knobs 810 are spaced apart from each other in the center 812 of stem 816 to contact both sides of the spinous process, but not the spinous process itself. Some or all of the knobs 810 may be left off of the instrument 800 and replaced with a beveled edge on the inside of the semi-circular stem 816. For example, it is within the scope of the present disclosure to provide two spaced-apart knobs 810 near the center 812 of stem 816 with beveled edges 814 on either side of the knobs 810.

Elements 810 are considered the tools of instrument 800 that will provide for more comfortable treatment and leverage.

The following description applies generally to instruments 100-800 of FIGS. 1A-8G.

These instruments 100-800 are unique in that they may be designed with a single or multiple knobs. The knobs may be provided in various shapes, sizes, and configurations, including spherical shapes (i.e., orbs) (e.g., knob 402 of instrument 400), semi-spherical shapes (i.e., half orbs) (e.g., knob 110 of instrument 100), and dome or mushroom shapes. In certain embodiments, the knobs may be provided on a beveled edged stick-like instrument with ergonomic curvilinear contact areas (e.g., edges 410, 412, 414, and 416 of instrument 400) and linear contact areas (e.g., edge 118 of instrument 100) to fit various body shapes. In other embodiments, the knobs may be provided on a dome-shaped body (e.g. body 606 of instrument 600) designed to fit within the palm of a practitioner's hand. The addition of knobs allows the application of deep acupressure, ischemic release or deep finger-like massage allowing the separation of muscle tissue and separate points of contact into the tissue.

According to an exemplary embodiment of the present disclosure, the knobs on the instruments 100-800 are designed to simulate the size of average human fingers or the human thumb and thus may be more effective and comfortable in applying deep pressure releases to tissues of the musculoskeletal fascial systems as well as into the muscles themselves. These tissues and fascial systems surrounding and penetrating the muscles, and extending into the fat and blood vessels are the targeted tissues in mechanical release therapy. This is important since it is theorized that deep tissue massage applied for extended amounts of time may release MSC's and pro resolving factors. Additionally, the instruments 100-800 will also facilitate the release of the adhesions, and restrictions as supported in previous literature.

Mechanical stimulation is currently thought to facilitate the release of MSC's that will aid the body in healing itself. Additionally, the mechanical pressure is thought to also affect the pro resolving factors in tissues and decrease body inflammation.

The presented instruments 100-800 combine the most effective aspects of tools from earlier instruments, and add an ergonomic design and new treatment edges (e.g., knob 408 of instrument 400 and the stacked knobs 708 and 710 of instrument 700) and other features unique to these instruments 100-800.

The present disclosure encompasses a set of instruments 100-800, ergonomically designed for both the client and the practitioner (e.g., handle 106 of instrument 100 enables a secure grip with an ergonomic angle 122), that specifically address the disadvantages of manual treatment. The instruments 100-800 are an adjunct to the practitioner's hands, to protect the wear and tear of joints. This does not discount the importance of manual treatment along with the use of instruments 100-800; rather it will assist the practitioner to apply more force without damage to their hands. Thus, it will allow manual interventions on patients all day, for long periods of treatment time. Each instrument 100-800 may be multifunctional in that it can be used for diagnosis (e.g., straight beveled end edge 316 of the handle 306 of instrument 300) and treatment (e.g., rounded top edge-314 of the handle 306 of instrument 300) of the myofascial system and adds additional myofascial tissue release techniques and acupressure. Each instrument 100-800 may be capable of at least two or three treatment modalities. Treatment modalities may include but are not limited to: scanning, scrapping, strumming, massaging, cross fiber, friction massage, deep massage, acupressure, ischemic release, and edema reduction. The shapes of the instruments 100-800 allow for rolling, kneading, petrissage or other deep massage techniques. The instruments 100-800 are noninvasive, rigid and have a handle (e.g., handle 106 of instrument 100). The rounded knobs (e.g., knobs 308 of instrument 300) unique to the instruments 100-800 simulate the ends of fingers and thumbs to add comfortable and safe force to the massage and myofascial release techniques.

Instruments 100-800 may be provided together in a kit including all of the instruments, individually, or in appropriate combinations. Instruments 500 and 600 are paired instruments designed for use as a single instrument or in pairs one for each hand to provide bilateral treatment simultaneously. This will enable the practitioner to treat two sides of the body synchronously as well as provide the economy of time.

Additionally each instrument 100-800 may be provided in a variety of sizes for use with patients of different sizes. For example, instrument 100 may be provided in a small size for use with human infant or adolescent patients, a medium size for use with human adult patients, and a large size for use with large animal patients (e.g., horses).

The advantages of this set of instruments 100-800 may include but are not limited to the following:

1. Facilitates the location of scar tissue, fibrous tissue, and injured soft tissue (e.g., straight beveled end edge 316 of the handle 306 of instrument 300).
2. Designed to match contour of areas of injury (e.g., edges 410, 412, 416 of instrument 400 and edge 414 of instrument 400).
3. Designed to treat specific areas without damaging surrounding tissue.
4. For use with humans or animals.
5. Curved shapes or specific arc shapes with concave beveled edge (e.g., edges 410, 412, and 416 of instrument 400) for working on fibrous tissue around joints.
6. Instruments with ergonomic curves (e.g., handle 106 of instrument 100 enables a secure grip with an ergonomic angle 122) built on the main platform for the protection of the practitioner's wrist.
7. Spherical shapes of various sizes to simulate fingers and thumbs to apply acupressure and other deep massage release techniques.
8. Able to reach difficult areas.
9. Fixed knobs of various shapes, sizes, and configurations that do not roll on instruments 100-800 are more comfortable than sharp edges and enable the practitioner to apply deep pressure in one location or over a large region to apply massage, acupressure, separate muscles or fascia with deep pressure for sustained periods without wear and tear to practitioner's digits (fingers).
10. Fixed knobs of various shapes, sizes, and configurations on instruments 100-800 allow the practitioners to apply joint stretching via joint mobilization on the spine with the use of PA, AP and rotatory glides on the transverse processes of the spinal joints without the joint stress and wear and tear to practitioner's fingers.
11. Instruments 100-800 with knobs of various shapes, sizes, and configurations add unique massage interventions which contrast and supplement thin metal edged massage tools.
12. Knobs of various shapes, sizes, and configurations massage and separate tissue facilitating healing (e.g., two spherical heads (orbs) 306 of instrument 300).

13. Thicker handled instruments (e.g., stem 106 of instrument 100) are more ergonomic for the therapist and the patient.
14. Ergonomically designed to minimize injury to the therapist (e.g., contours 612, 614, 616, 618, 620, and 624 of instrument 600).
15. Designed for soft tissue massage (e.g., knobs 608 and 622 of instrument 600).
16. Designed for acupressure and ischemic release (e.g., knob 110 of the instrument 100).
17. Add additional deep and light massage techniques to myofascial tissues (e.g., two half orbs 710 stacked on the full orbs 708 of instrument 700).
18. Instruments 100-800 may be available for the practitioner to sell to the patients to continue follow up of treatment at home and after discharge.
19. The metal line will be easily used by several practitioners in large clinic setting and allow stricter sanitizing procedures.
20. These instruments 100-800 can be made available to general public to be used on humans and animals who would benefits from myofascial interventions.
21. The rounded knob (e.g., knob 408 of instrument 400) can be used like a finger to apply joint mobilization via accessory movement of the spinal joints like posterior to anterior glides (PA) and rotary glides of individual spinal segments.

The presented instruments 100-800, are designed to augment current tools available as well as provide other unique advantages not available in other instruments currently in use.

The presented instruments 100-800 are designed to have multiple applications (i.e., each instrument incorporates 2-4 tools designed to treat specific areas of the body). The presented instruments 100-800 address the need for ergonomic curves and leverage advantages in a more comfortable ergonomic design. Additionally, the presented instruments 100-800, address the current research indicating that using edged metal instruments (and other materials) on soft tissues will reduce fibrosis, adhesion, scars tissue, and decrease pain.

The use of instrument assisted massage for the treatment of pain and dysfunction of body tissues, has been sited in past research to facilitate the healing of tendon, ligament and muscle by assisting the break down scar tissue, fibrosis and restrictions to provide uniform and strong fibers.

The most current research and thought of IASTM suggest that many things are occurring at a cellular level to enhance healing, decrease pain, and promote normal tissue mobility, thus increasing function of the involved tissues. It has been suggested in the more current research that longer massage times, deep pressures, the use of ischemic pressures, and the skill of the practitioner targeting precise soft tissues may provide the best results to stimulate the phases of healing.

The variety of tools per instrument and the ergonomic design of the instruments 100-1700 as well as the talent of the practitioner to apply the tools to the correct tissues will provide an optimal therapeutic mixture.

The presented instruments 100-800 combine the most effective aspects of tools from earlier instruments, and adds an ergonomic design and new treatment edges and features unique to these instruments.

The instruments 100-800 described in this patent differ somewhat in size and shape, but at the same time have key elements in common. They vary in size and shape to accommodate different areas of the body and different size patients.

The instruments 100-800 described can be used to treat fibrotic tissue, massage soft tissue, enable deep tissue release, mobilize misaligned joints, and perform deep acupressure and ischemic compression release. The instruments 100-800 will also be available for use by the patient to follow up the treatment plan the practitioner has outlined. This will assist in keeping tissues healthy, supple, prepare tissues for manual stretching by the practitioner, and self-stretching by the patient, to promote healing, and help decrease inflammation and pain. Proper use of these instruments may promote healing factors (i.e., the release of MSCs, decrease scar tissue, remove fibrotic ridges, nodules, granules, gritty tissue and tissue thickening). These instruments 100-800 are additionally designed with unique ergonomic features to reduce stress, strain and injury to the practitioner and to allow acupressure and unique muscle massage techniques All these new instrument designs combine to offer unique features designed to aid in the self-healing of the body. Additionally, they can be used to augment current available linear flat edged tools.

Common elements of instruments 100-800 may include the following:

1. Knobs of various shapes, sizes, and configurations, including rounded spherical shapes (i.e., orbs) (e.g., knob 408 of instrument 400), semi-spherical shapes (i.e., half orbs), or a dome or mushroom shape (e.g., 110 of instrument 100).
2. An angled stem or handle (e.g., angle 122 of instrument 100) that transitions from the body of the tool to the head that is also an ergonomic angle for the therapist.
3. The handle of the instrument may have two treatment edges, one at the top or side that may be rounded and one at the bottom or side that may be beveled (e.g., edges 114 and 116 of instrument 100).
4. The tail end of the instrument may be used for treatment. The tail end may be either a beveled edge or a rounded cone shape (e.g., edge 316 of instrument 300 and 120 of instrument 100).
5. There may be concave and convex curvilinear edges (e.g., edges 412 and 414 of instrument 400) to accommodate treatment on various parts of the body, which may contain a specific bevel.
6. The instruments 100-800 may be formed from a rigid, resonant material. For example, the instruments 100-800 may be formed from wood, plastic, or composite materials for personal use. Such instruments may be lightweight, easy to handle, and affordable. Alternatively, the instruments 100-800 may be formed from metal (e.g., aluminum, stainless steel) for medical use. Such instruments may be heavy and easy to sterilize, but more expensive.
7. The instruments 100-800 are capable of being used with a suitable lubricant.
8. The instrument handles (e.g., 106 of instrument 100) may have a slip-resistant surface to facilitate grip depending on the material out of which they are made. Such slip-resistant surfaces may be formed by applying a coating to the handle or etching a design into the handle, for example. The pattern and texture of the slip-resistant surface may vary.

While this invention has been described as having exemplary designs, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A diagnostic and therapeutic instrument for use by a practitioner with a patient's soft tissue, the instrument comprising:

a head end;

a tail end;

a tubular shaft having a head portion adjacent to the head end, a tail portion adjacent to the tail end, and a middle portion therebetween, wherein the tubular shaft extends between the head end and the tail end to serve as a handle, the handle having:

an upper surface configured to receive pressure from the practitioner, the entire extent of the upper surface having a flat or convex profile such that the shaft angles downward toward the patient from the tail end to the head end, the upper surface lacking any concave profile that angles upward away from the patient; and at least three rounded corners configured to be ergonomically held by the practitioner;

wherein at least a portion of the middle portion of the tubular shaft has a first width that is less than a second width of the head portion and less than a third width of the tail portion; and at least one knob located at the head end, the knob facing downward opposite the upper surface of the handle and being configured to interact with the patient's soft tissue, wherein an entire periphery of the head end, including the at least one knob, is immobile relative to the shaft.

2. The instrument of claim 1, wherein the tubular shaft has at least one beveled edge configured to interact with the patient's soft tissue.

3. The instrument of claim 2, wherein the at least one beveled edge is located on a top side of the tubular shaft and has a convex curvature.

4. The instrument of claim 2, wherein the at least one beveled edge is located on a bottom side of the tubular shaft and has a concave curvature.

5. The instrument of claim 2, wherein the at least one beveled edge is located on the tail end of the tubular shaft and is straight.

6. The instrument of claim 1, wherein the angle between the head end and the tail end is an obtuse angle.

7. The instrument of claim 1, wherein the handle includes a non-slip surface.

8. The instrument of claim 1, wherein the at least one knob has a diameter of ¼ inch to 2 inches.

9. The instrument of claim 1, further comprising a second knob located at the tail end of the tubular shaft and having a diameter of ¼ inch to 1 inch.

10. The instrument of claim 1, wherein the at least one knob is one of spherical, semi-spherical, and mushroom shaped.

11. The instrument of claim 1, wherein the at least one knob includes a first knob and a second knob located at the head end of the instrument, the first and second knobs being spaced apart from each other along a longitudinal axis of the shaft.

12. The instrument of claim 1, wherein the instrument is made of a rigid, resonant material configured to transmit diagnostic information through the resonant material from the patient's soft tissue to the practitioner holding the handle.

* * * * *